US005642777A

United States Patent [19]

Kang et al.

[11] Patent Number: 5,642,777

[45] Date of Patent: Jul. 1, 1997

[54] FIN TUBE HEAT EXCHANGER

[75] Inventors: Tae Wook Kang; Kam Gyu Lee, both of Busan, Rep. of Korea

[73] Assignee: LG Electronics Inc., Seoul, Rep. of Korea

[21] Appl. No.: 590,320

[22] Filed: Jan. 23, 1996

[30] Foreign Application Priority Data

Jan. 23, 1995 [KR] Rep. of Korea ..... 1995-1079

[51] Int. Cl.[6] ..... F28D 1/04

[52] U.S. Cl. ..... 165/146; 165/151; 165/181

[58] Field of Search ..... 165/151, 181, 165/146

[56] References Cited

U.S. PATENT DOCUMENTS

| | | | |
|---|---|---|---|
| 3,135,320 | 6/1964 | Forgo | 165/151 |
| 5,042,576 | 8/1991 | Broadbent | 165/151 |
| 5,062,475 | 11/1991 | Bemisderfer et al. | 165/151 |
| 5,099,914 | 3/1992 | Reifel | 165/151 |
| 5,117,902 | 6/1992 | Kusuhara et al. | 165/151 |

FOREIGN PATENT DOCUMENTS

| | | | |
|---|---|---|---|
| 1212901 | 3/1960 | France | 165/151 |
| 171596 | 7/1990 | Japan | 165/151 |
| 93595 | 3/1992 | Japan | 165/151 |

*Primary Examiner*—Leonard R. Leo

[57] ABSTRACT

A fin tube heat exchanger for use in an air conditioner includes a plurality of fin plates spaced at regular intervals, disposed in parallel with one another. A plurality of heat exchange tubes extend through the fin plates in a direction perpendicular to planes in which the fin plates lie. A plurality of raised strips formed in a lower row have a height lower than those on the highest row, which causes water drops to readily drop along the fin plate. A plurality of embossed projection parts may be formed instead of or in addition to the raised strips.

7 Claims, 7 Drawing Sheets

FIN TUBE HEAT EXCHANGER

BACKGROUND OF THE INVENTION

The present invention generally relates to a heat exchanger, and more particularly, to a fin tube heat exchanger for use in an air conditioner or the like.

FIG. 1 depicts a conventional fin tube heat exchanger. As shown in FIG. 1, a heat exchanger 1 is provided with a plurality of fin plates 2 of aluminum spaced at regular intervals and a plurality of heat exchanger tube 3 extending through the fin plates 2. The heat exchanger tubes 3 are securely held in openings 4 formed in the fin plates 2 by any suitable means.

As shown in FIGS. 2 to 3, each fin plate 2 has a plurality of narrow cut-out strips extending across the direction of flow. These strips are raised from the plane in which the fin plate 2 lies for raising the heat exchanging performance. Raised strips 5–8 or 5–8' extend in a direction perpendicular to the direction of air flow shown by arrows A and B. The raised strips 5–8 are formed on the same side of each fin plate 2 in FIG. 2B whereas the raised strips 5–8' are form alternately on both sides of each fin plate 2 in FIG. 2C. In the case of the raised strips 5–8' as shown in FIG. 2C, water drops tend to stay substantially in the form of a bridge between adjacent raised strips 5–8', water drops do not drop from the fin plate until they grow into a considerable size.

Japanese Patent Laid-open Application No. 48-58434 discloses another configuration of raised strips as shown in FIGS. 3A to 3C. Similar to the heat exchanger disclosed in the foregoing Publication, raised strips 9–14 or 9–14' extend in a direction perpendicular to the direction of air flow shown by arrows A and B. The raised strips 9–14 are formed on the same side of each fin plate 2 in FIG. 3B whereas the raised strips 9–14' are formed alternately on both sides of each fin plate 2 in FIG. 3C. In the same fashion as disclosed in the foregoing Publication, water drops tend to stay between adjacent raised strips 9–14 or 9–14'. In this case, however, since each fin plate 2 is provided with a draining passage along the center line of a row of heat exchanger tubes, not as pattern as shown in FIGS. 2A to 2C, but the heat exchanging performance is still lowered.

As shown in FIG. 4, the raised strips are formed closer at the upper portion than at the lower portion of each fin plate, which causes water drops to readily drop along the fin plate and reduces the flows resistance. Accordingly, the extreme reduction of the heat exchanging performance which is primarily caused by the reduction in air quantity can be prevented.

In addition, since the raised strips 16*a*–18*b* on the one side are manufactured by a puncher and the raised strips 116*a*–118*b* on the other side are manufactured by the same puncher, it is possible to manufacture the raised strips at a low cost and in detail, but it is impossible to remove the water drops completely between the raised strips and the fin plate 15 or between adjacent raised strips.

SUMMARY OF THE INVENTION

Accordingly, the present invention has been developed with a view towards substantially eliminating the above described disadvantage inherent in the prior art fin tube exchanger, and has for its essential object to provide an improved fin tube heat exchanger which has stable fin efficiency by forming the lower raised strips with a lower height than those on the highest row, or by forming embossed projection parts on one side.

In accomplishing the above object, according to one preferred embodiment of the present invention, there is provided a fin tube heat exchanger having therein a plurality of plate-shaped and regularly spaced fin members, a plurality of heat exchanger tubes inserted into through-holes defined in each fin member and a plurality of raised pieces formed in each fin member, each of the raised pieces arranged in a plurality of rows, being the lower row raised pieces having a height less than those on the upper row.

According to another aspect of the present invention a plurality of embossed projection parts are formed on the fin members which have similar area and shape to the raised strips, but have a different height from the raised strips. According to a further aspect of the present invention, the height of the raised strips declines from the upper portion to the lower portion.

BRIEF DESCRIPTION OF THE DRAWINGS

The present invention will become more apparent from the following description taken in conjunction with the preferred embodiment thereof with reference to the accompanying drawings, throughout which; like parts are designated by like reference numbers, and in which.

DETAILED DESCRIPTION OF THE INVENTION

Figure 1:
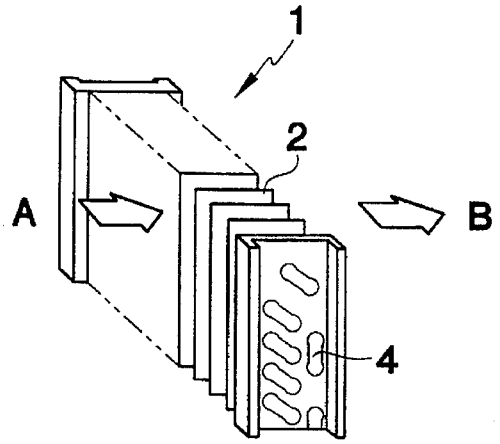
FIG. 1 PRIOR ART
FIG. 1 is a perspective view of a conventional fin tube heat exchanger.
Figure 2A:
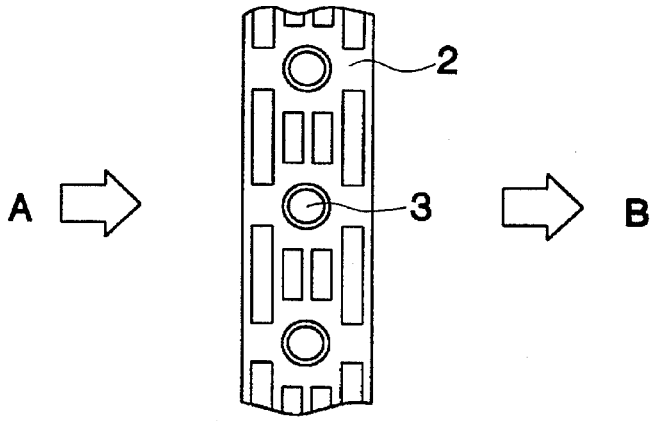
FIG. 2A PRIOR ART
FIG. 2(A) is a front view of a conventional fin plate mounted in the heat exchanger of FIG. 1.
Figure 2B:
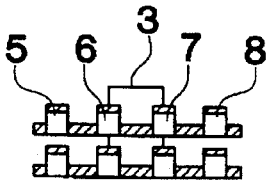
FIG. 2B PRIOR ART
FIGS. 2(B) and 2(C) are sectional views taken along the lines A—A and B—B in FIG. 2(A), respectively, illustrating two typical examples of raised strips formed on the fin plate.
Figure 2C:
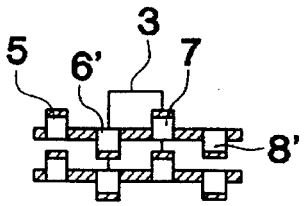
FIG. 2C PRIOR ART
Figure 3A:
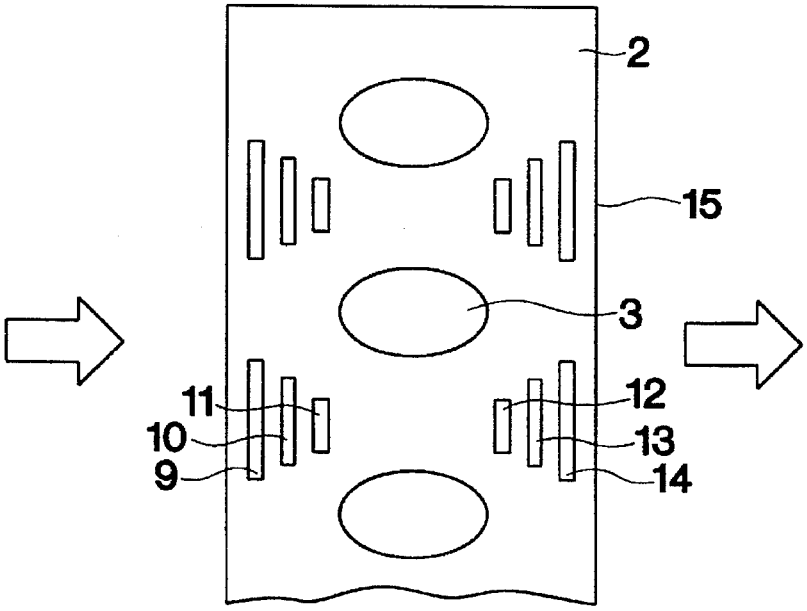
FIG. 3A PRIOR ART
FIG. 3(A) is a front view of another conventional fin plate.
Figure 3B:
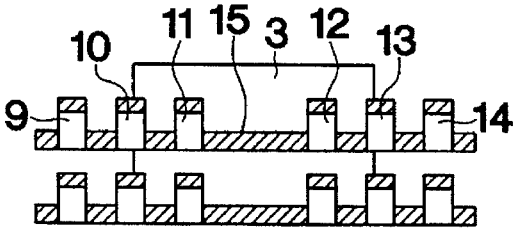
FIG. 3B PRIOR ART
FIGS. 3(B) and 3(C) are sectional views taken along the lines A—A and B—B in FIG. 3(A), respectively, indicating two examples of the raised strips.
Figure 3C:
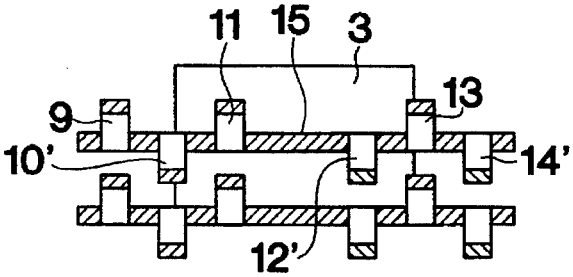
FIG. 3C PRIOR ART
Figure 4:
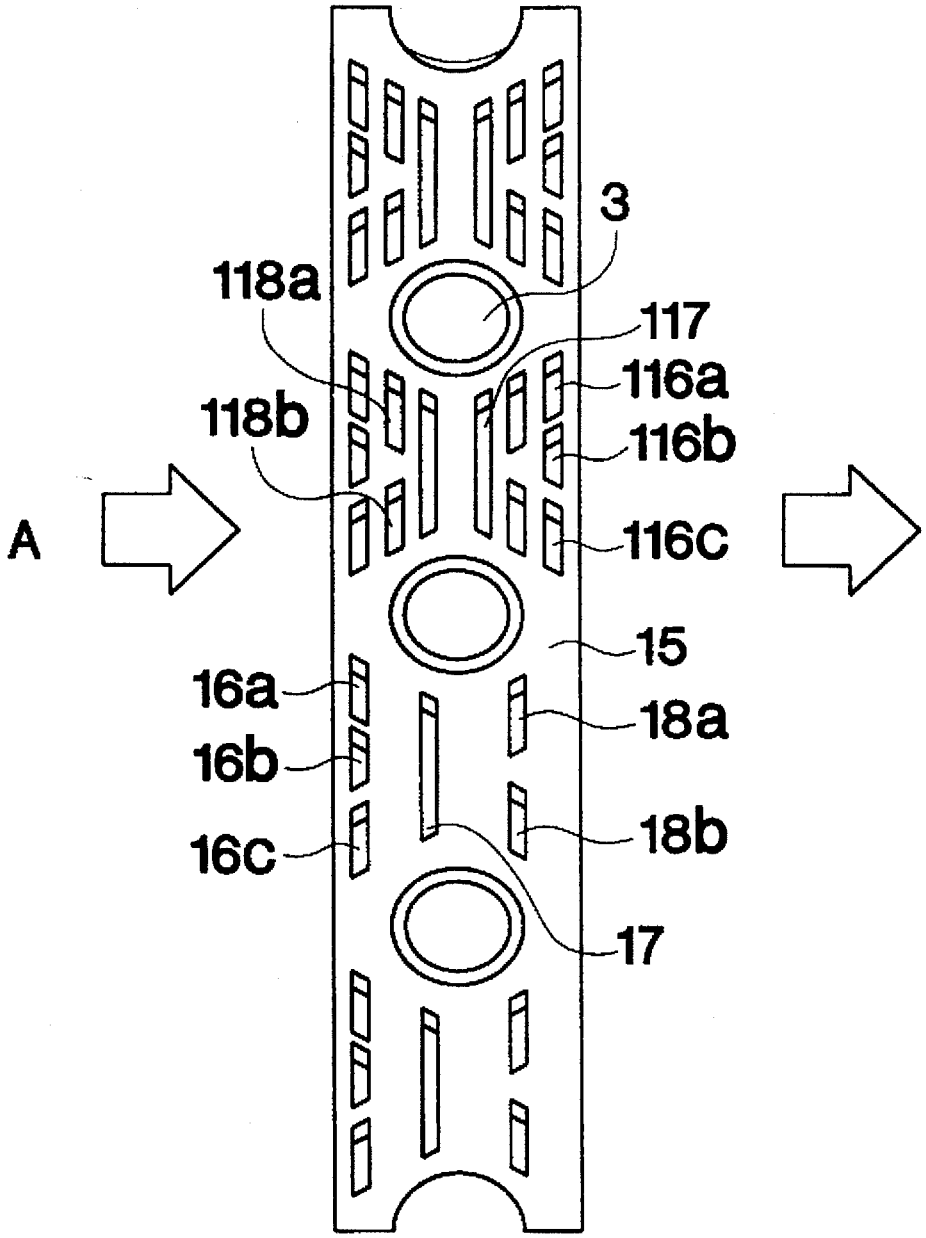
FIG. 4 PRIOR ART
FIG. 4 is a front view of a further conventional fin plate.

It is initially noted that a fin tube heat exchanger according to the present invention has an external appearance to that of the conventional fin tube heat exchanger as shown in FIG. 1.

Figure 5A:
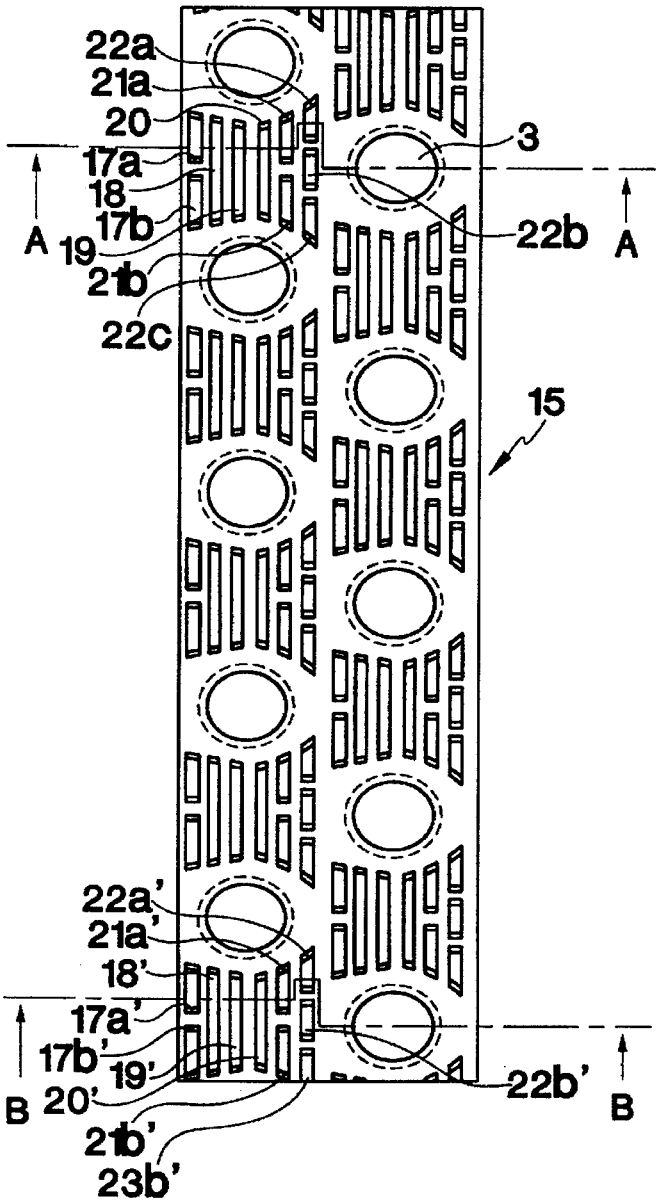
FIG. 5(A) is a front view of a fin plate according to a first embodiment of the present invention.
Figure 5B:
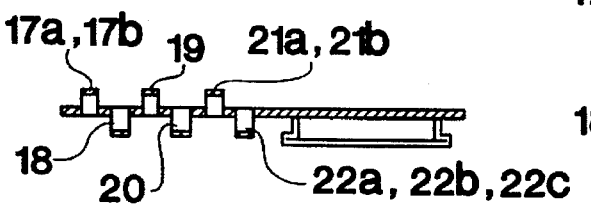
FIGS. 5(B) and 5(C) are sectional views taken along the lines A—A and B—B in FIG. 5(A), respectively, indicating two examples of the raised strips.
Figure 5C:
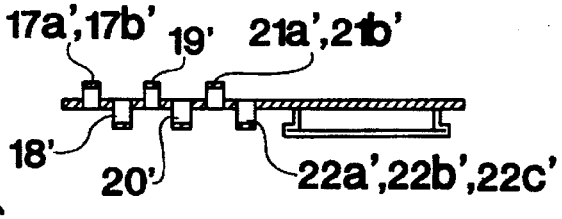

Similar to the conventional fin tube heat exchanger, a heat exchanger of the present invention is provided with a plurality of fin plates spaced at regular intervals and a plurality of heat exchanger tubes extending securely held in openings formed in the fin plates. Each fin plate has a plurality of cut-out narrow strips extending across the direction of air flow. These strips are raised from the plane in which the fin plate lies for raising the heat exchanging performance. FIG. 5(A) depicts a fin plate 15 mounted in a fin tube heat exchanger according to a first embodiment of the present invention.

As shown in FIG. 5(A), raised strips 17*a*–22*c* and 17*a*'–22*c*' extend in a direction perpendicular to the direction of air flow shown by arrows A and B. Each raised strip has two leg portions connecting it with the fin plate 15. The leg portions of the raised strips are inclined with respect to the direction of air flow. In a plurality of rows, a plurality of the lower raised strips 17'–22' than those 17*a*–22*c* on the highest row are formed or a plurality of the lower embossed projection parts than those on the highest row are formed on one side.

Figure 6:
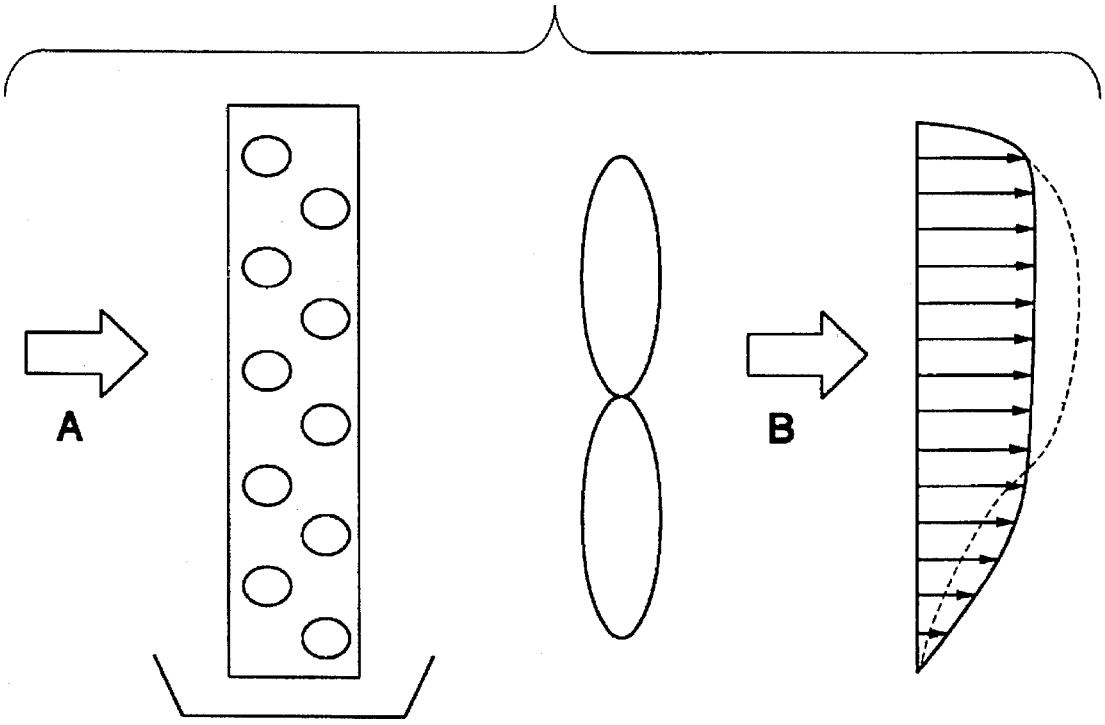
FIGS. 6(A) and FIG. 6(B) are diagrams of distribution of wind volume in the group of cutouts in FIG. 5(A)

Referring to FIG. 6, the part shown in dotted line is depicted in the case where raised strips are equally formed and the part shown in a solid line in the case where the lower raised strips or the lower embossed projection parts are formed except those on the highest row. In this case, the wind velocity is uniformly distributed over the fin plate.

Figure 7A:
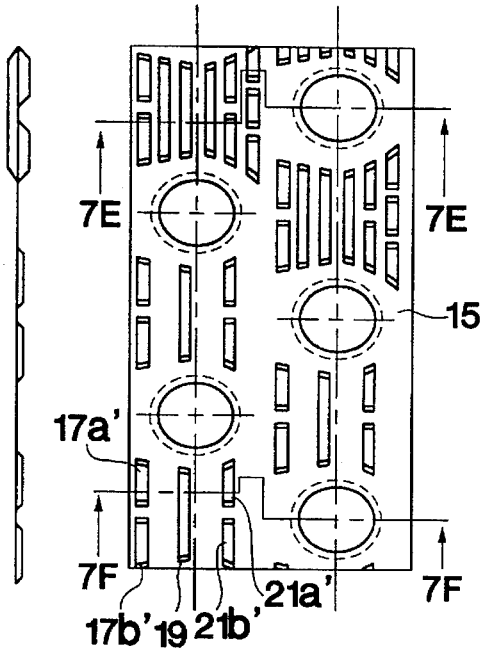
FIGS. 7(A) to 7(L) are front views and sectional views of fin plates according to other embodiments of the present invention.

FIG. 7(A) depicts fin plate 15 mounted in a fin tube heat exchanger according to a second embodiment of the present invention. As shown in FIG. 7(A), a plurality of the lower raised strips 17*a*'–21*b*' than those on the highest row are formed only on the one side of the fin plate 15 and at regular intervals along the center line of the heat exchanger tubes.

Figure 7B:
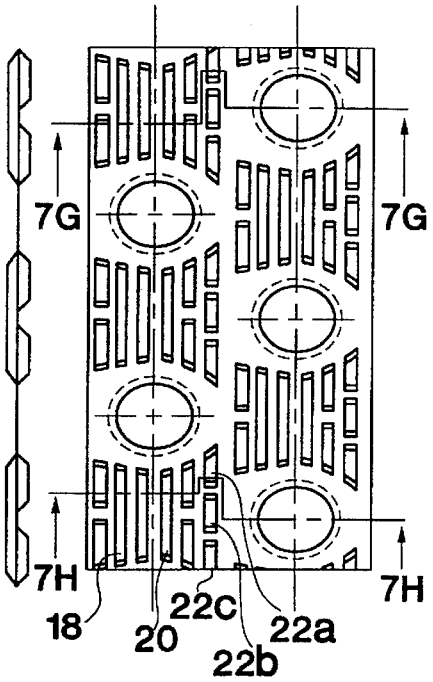
Figure 7E:
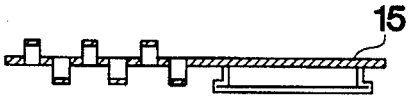
Figure 7G:
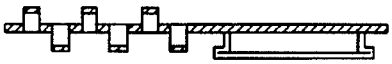
Figure 7F:
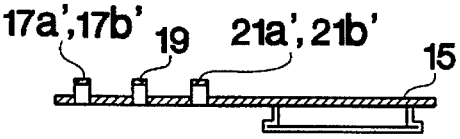
Figure 7H:
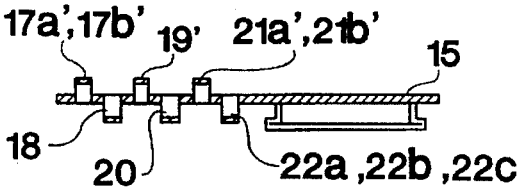

FIG. 7(B) depicts fin plate 15 mounted in a fin tube heat exchanger according to a third embodiment of the present invention. As shown in FIG. 7(B), a plurality of the lower raised strips 17*a*'–21*b*' than those on the highest row are formed on the one side of the fin plate 15 and a plurality of the same raised strips 18–22*c* to those on the highest row are formed on the other side of the fin plate 15.

Figure 7C:
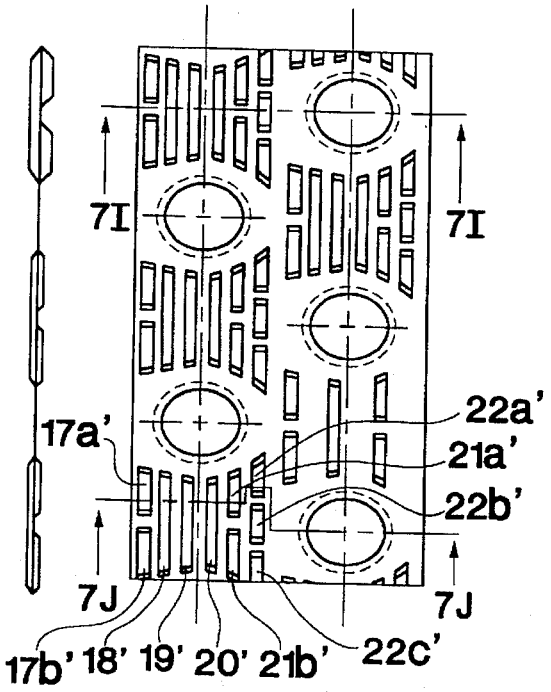

FIG. 7(C) depicts fin plate 15 mounted in a fin tube heat exchanger according to a fourth embodiment of the present invention. As shown in FIG. 7(C), a plurality of the lower embossed projection parts 18'–22' with the similar area and shape to those on the highest row are formed on both side of the fin plate 15.

Figure 7D:
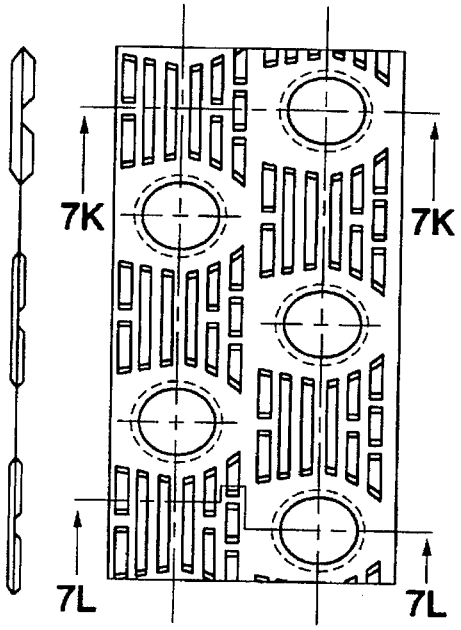
Figure 7I:
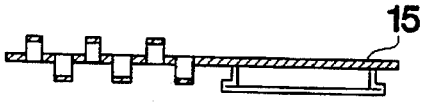
Figure 7K:
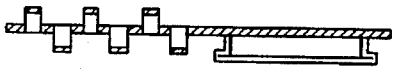
Figure 7J:
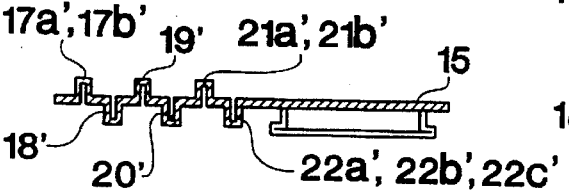
Figure 7L:
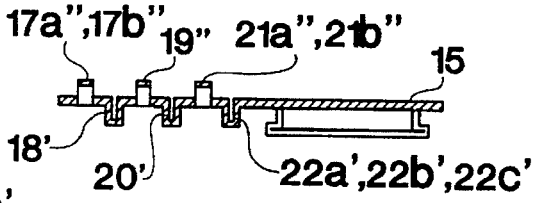

FIG. 7(D) depicts fin plate 15 mounted in a fin tube heat exchanger according to a fifth embodiment of the present invention. As shown in FIG. 7(D), a plurality of the lower raised strips 17*a*"–21*b*" than those on the highest row are formed on one side of the fin plate 15 and a plurality of the lower embossed projection parts 18'–22*c*' than those on the highest row are formed on the other side of the fin plate 15.

The heat exchanger having the above described structure provides the following effects when used as an evaporator. The novel strip pattern, in which a plurality of the lower raised strips than those on the highest row are formed or a plurality of the lower embossed projection parts with the similar area to those on the highest row are formed, causes water drops to readily drop along the fin plate 15 and reduces the flow resistance. Accordingly, the extreme reduction of the heat exchanging performance which is primarily caused by the reduction in air quantity can be prevented. In addition, the reduction of the generation of water drops in the form of a bridge reduces the flow resistance and raises the heat exchanging performance. Further, the louvering effect by forming the embossed projection parts causes the heat exchanging performance to be maintainable, and furthermore causes the windy velocity distribution to be uniform by reducing the generation of water drops in the form of a bridge. In addition, since the raised strips and the embossed projection parts are formed by controlling the puncher stroke, a fin tube heat exchanger can be readily manufactured at a low cost.

While specific embodiments of the invention have been illustrated and described herein, it is to be realized that modifications and changes will occur to those skilled in the art. It is therefore to be understood that the appended claims are intended to cover all modifications and changes as fall within the true spirit and scope of the invention.

We claim:

1. A fin tube heat exchanger for use in an air conditioner, said fin tube heat exchanger comprising:

a plurality of fin plates spaced at regular intervals, disposed in parallel with one another and adapted to allow air to flow therebetween;

a plurality of heat exchange tubes extending through said fin plates in a direction perpendicular to planes in which said fin plates lie; and each of said fin plates having a plurality of raised strips formed in upper and lower rows on said fin plates, said raised strips in said lower row having a projecting height which is lower than a projecting height of said raised strips in the upper row, and a plurality of embossed projection parts formed on said fin plates which have similar area and shape to said raised strips, but different height from said raised strips.

2. The fin tube heat exchanger as claimed in claim 1, wherein the height of said raised strips declines from the upper row to the lower row.

3. The fin tube heat exchanger according to claim 1, wherein said plurality of raised strips formed in said lower row project from an opposite surface of said fin plate from said embossed projections.

4. A fin tube heat exchanger comprising:

a plurality of fin plates spaced apart at regular intervals, disposed in parallel with one another and adapted to allow air to flow therebetween;

a plurality of heat exchange tubes extending through said fin plates in a direction perpendicular to planes in which said fin plates lie; and each of said fin plates having an upper row of raised strips projecting from a surface of said fin plates by a first distance, each of said fin plates further having a lower row of embossed projections projecting from said surface of said fin plates by a second distance less than said first distance.

5. The fin tube heat exchanger according to claim 4, further including a plurality of raised strips formed in said lower row.

6. The fin tube heat exchanger according to claim 5, wherein said plurality of raised strips formed in said lower row project from an opposite surface of said fin plate from said embossed projections.

7. The fin tube heat exchanger according to claim 4, wherein said embossed projections project from opposing surfaces of said fin plate.

* * * * *